US008149173B2

(12) United States Patent
Brown

(10) Patent No.: US 8,149,173 B2
(45) Date of Patent: Apr. 3, 2012

(54) MODIFIED LOOP ANTENNA

(75) Inventor: Forrest James Brown, Carson City, NV (US)

(73) Assignee: DockOn AG, Zurich (CH)

( * ) Notice: Subject to any disclaimer, the term of this patent is extended or adjusted under 35 U.S.C. 154(b) by 0 days.

(21) Appl. No.: 12/921,124

(22) PCT Filed: Mar. 26, 2009

(86) PCT No.: PCT/GB2009/050296

§ 371 (c)(1),
(2), (4) Date: Sep. 3, 2010

(87) PCT Pub. No.: WO2009/118565

PCT Pub. Date: Oct. 1, 2009

(65) Prior Publication Data

US 2011/0012806 A1 Jan. 20, 2011

(30) Foreign Application Priority Data

Mar. 26, 2008 (GB) ..... 0805393.6

(51) Int. Cl.
*H01Q 1/38* (2006.01)

(52) U.S. Cl. ..... 343/700 MS; 343/726

(58) Field of Classification Search ..... 343/700 MS, 343/726, 725, 728, 730, 732, 742, 744, 866
See application file for complete search history.

(56) References Cited

U.S. PATENT DOCUMENTS

| | | | | |
|---|---|---|---|---|
| 4,809,009 | A * | 2/1989 | Grimes et al. | 343/726 |
| 5,061,938 | A | 10/1991 | Zahn et al. | |
| 5,376,942 | A | 12/1994 | Shiga | |
| 5,751,252 | A | 5/1998 | Phillips | |
| 6,437,750 | B1 | 8/2002 | Grimes et al. | |
| 6,677,901 | B1 | 1/2004 | Nalbandian | |
| 7,215,292 | B2 | 5/2007 | Mclean | |
| 2007/0080878 | A1 | 4/2007 | McLean | |
| 2009/0160717 | A1 * | 6/2009 | Tsutsumi et al. | 343/726 |
| 2009/0224990 | A1 * | 9/2009 | Cezanne et al. | 343/726 |

FOREIGN PATENT DOCUMENTS

| | | | |
|---|---|---|---|
| EP | 1672735 | A1 | 6/2006 |
| JP | 03-050922 | A | 3/1991 |
| JP | 05-183317 | A | 7/1993 |
| JP | 2003-258546 | A | 9/2003 |
| WO | 00-25385 | A | 5/2000 |
| WO | 2005-062422 | A1 | 7/2005 |

OTHER PUBLICATIONS

H.A. Wheeler, "Small antennas," IEEE Trans. Antennas Propagat., vol. AP-23, No. 4, pp. 462-469, Jul. 1975.

R.C. Hansen, "Fundamental limitations in antennas," Proc. IEEE, vol. 69, No. 2, pp. 170-182, Feb. 1981.

L.J. Chu, "Physical Limitations of Omni-Directional Antennas," J. Appl. Phys., vol. 19, pp. 1163-1175, Dec. 1948.

H.A. Wheeler, "Fundamental Limitations of Small Antennas", Proc. IRE, vol. 35, pp. 1479-1484, Dec. 1947.

(Continued)

*Primary Examiner* — Hoanganh Le

(74) *Attorney, Agent, or Firm* — SilverSky Group, LLC

(57) ABSTRACT

Disclosed is an antenna comprising a loop element (10) and an Electric-field radiator (30), wherein the E-field radiator is electrically coupled to the loop element such that at the frequency of operation, there is a substantially 90 degree phase difference between the Electric and Magnetic fields produced by the antenna.

14 Claims, 4 Drawing Sheets

OTHER PUBLICATIONS

R.F. Harrington, "Effect of Antenna Size on Gain, Bandwidth and Efficiency", J. Res. Nat. Bur. Stand., vol. 64D, pp. 1-12, Jan.-Feb. 1960.
R.L. Fante, "Quality factor of general ideal antennas," IEEE Trans. Antennas Propag., vol. AP-17, No. 2, pp. 151-155, Mar. 1969.
D.M. Grimes and C.A. Grimes, "The Complex Poynting Theorem Reactive Power, Radiative Q, and Limitations on Electrically Small Antennas," IEEE, pp. 97-101, 1995.
C.A. Grimes and D.M. Grimes, "The Poynting Theorems and The Potential for Electrically Small Antennas," Proceedings IEEE Aerospace Conference, pp. 161-176, 1997.
F. Tefiku and C.A. Grimes, "Coupling Between Elements of Electrically Small Compound Antennas," Microwave and Optical Technology Letters, vol. 22, No. 1, pp. 16-21, 1999.
McLean, J.S., "The Application of the Method of Moments to Analysis of Electrically Small 'Compound' Antennas," IEEE EMC Symp., pp. 119-124, Aug. 1995.
J.C.-E. Sten and A. Hujanen, "Notes on the quality factor and bandwidth of radiating systems", Electrical Engineering 84, pp. 189-195, 2002.
R.E. Collin and S. Rothschild, "Evaluation of antenna Q," IEEE Trans Antennas Propagat., vol. 44, pp. 23-27, 1964.
A.D. Yaghjian and S.R. Best, "Impedance, bandwidth, and Q of antennas," IEEE Trans. Antennas Propagat., vol. 53, No. 4, pp. 1298-1324, Apr. 2005.
D.K. Cheng, "Optimization techniques for antenna arrays," Proc. IEEE, vol. 59, No. 12, pp. 1664-1674, Dec. 1971.
Yazdanboost, K.Y., Kohno, R., "Ultra wideband L-loop antenna" in Ultra-Wideband, 2005. ICU 2005. 2005 IEEE International Conference on. Issue Date: Sep. 5-8, 2005, pp. 201-205. ISBN: 0-7803-9397-X.
Chan et al., "Printed Antenna Composed of a Bow-tie Dipole and a Loop," IEEE Antennas and Propagation International Symposium 2007, Jun. 2007, pp. 681-684, IEEE, 1-4244-0878-4/07.
Grimes et al., "Bandwidth and Q of Antennas Radiating TE and TM Modes", IEEE Transactions on Electromagnetic Compatibility, vol. 37., No. 2, May 1995.
Grimes et al., "Minimum Q of Electrically Small Antennas: A Critical Review", Microwave and Optical Technology Letters, vol. 28., No. 3, Feb. 5, 2001.
McLean, James S., "A Re-examination of the Fundamental Limits on the Radiation Q of Electrically Small Antennas", IEEE Transactions on Antennas and Propagation, vol. 44, No. 5, May 1996.
Overfelt et al., "A Colocated Magnetic Loop, Electric Dipole Array Antenna (Preliminary Results)", Naval Air Warfare Center Weapons Division, China Lake, CA, Sep. 1994.

* cited by examiner

MODIFIED LOOP ANTENNA

The present invention relates to improvements to antennas. It relates particularly, but not exclusively, to modified loop antennas and finds particular but not exclusive application in mobile and/or hand-held devices.

Electromagnetic waves travelling in space comprise an Electric (E) and a Magnetic (H) field, generally arranged mutually perpendicular. Known loop antennas (also known as magnetic loop antennas) are generally used as receive antennas only and, even then, are generally used as near field antennas, for instance, in metal detectors and solar devices. Such loop antennas are not typically used as transmit antennas due to their low radiation efficiency i.e. the proportion of energy leaving the antenna compared to that fed into it.

Previous thinking, therefore, tends to be prejudiced against loop antennas for applications where transmission and reception are needed together. This is even though loop antennas are able to offer a very wide bandwidth compared to other forms of known antennas, such as dipoles and other similar constructions. There is a particular prejudice against small loop antennas i.e. those having a diameter of less than about one wavelength.

It is therefore an aim of embodiments of the present invention to provide an improved loop antenna, capable of operating in both transmit and receive modes and enabling greater radio performance than known loop antennas.

According to the present invention there is provided an apparatus as set forth in the appended claims. Other features of the invention will be apparent from the dependent claims, and the description which follows.

For a better understanding of the invention, and to show how embodiments of the same may be carried into effect, reference will now be made, by way of example, to the accompanying diagrammatic drawings in which.

The ever decreasing size of modern telecommunication devices creates a need for improved antenna designs. Known antennas in devices such as mobile/cellular telephones provide one of the major limitations in performance and are almost always a compromise in one way or another.

In particular, the efficiency of the antenna can have a major impact on the performance of the device. A more efficient antenna will radiate a higher proportion of the energy fed to it from a transmitter. Likewise, due to the inherent reciprocity of antennas, a more efficient antenna will convert more of a received signal into electrical energy for processing by the receiver.

The impedance at the output of a transceiver is typically 50 Ohms and so in order to ensure maximum throughput of energy (in both transmit and receive modes) the antenna should have a 50 Ohm impedance too. Any mismatch between the two will result in sub-optimal performance with, in the transmit case, energy being reflected back from the antenna into the transmitter. In the receive case, the sub-optimal performance presents itself as a lower received power than would otherwise be possible.

Known simple loop antennas are typically current fed devices, which produce primarily a magnetic (H) field. As such they are not typically suitable for transmit purposes. This is especially true of small loop antennas (i.e. those smaller than, or having a diameter less than, one wavelength) In contrast, voltage fed antennas, such as dipoles, produce both E and H fields and can be used in both transmit and receive modes.

The amount of energy received by, or transmitted from, a loop antenna is, in part, determined by its area. Each time the area of the loop is halved, the amount of energy which may be received/transmitted is reduced by 3 db. This physical constraint tends to mean that very small loop antennas cannot be used in practice.

Figure 1:
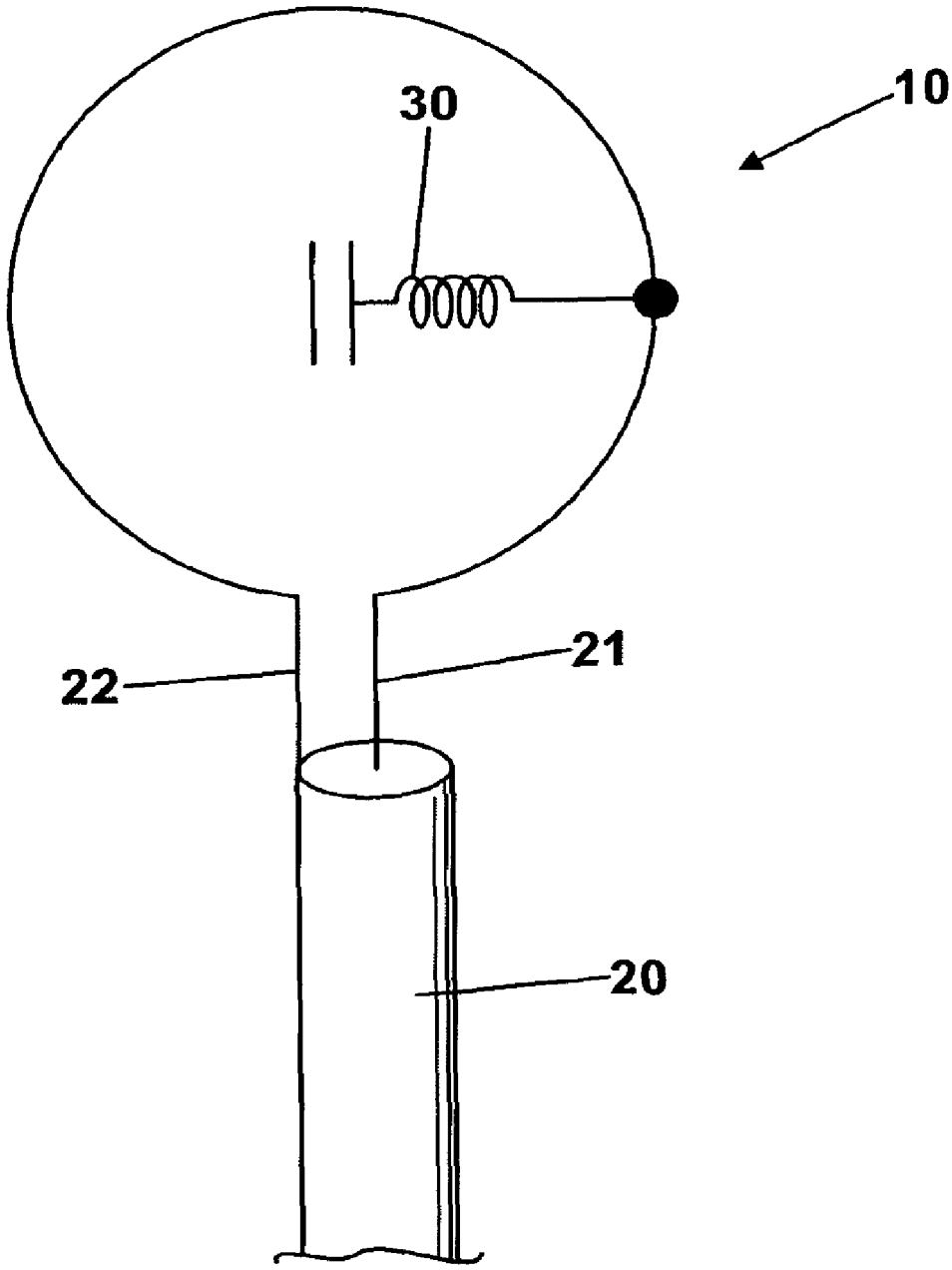
FIG. 1 shows a schematic representation of an embodiment of the present invention.

The antenna shown schematically in FIG. 1 is a loop antenna 10. It is presented here for ease of understanding. An actual embodiment of the present invention is unlikely to physically resemble the antenna shown. In this case, it is shown being fed from a coaxial cable 20 i.e. one end of the loop is connected to the central conductor 21 of the cable 20 and the other end of the loop is connected to the outer sheath 22 of the cable 20. The loop antenna 10 differs from a known loop antenna in that it comprises a series resonant circuit 30, coupled to the loop part of the way around its circumference. The location of this coupling plays an important part in the operation of the antenna.

By careful positioning of the series resonant circuit 30, the E and H fields generated/received by the antenna can be made to be orthogonal to each other. This has the effect of enabling the electromagnetic wave to propagate through space effectively. In the absence of both E and H fields, arranged orthogonally, the wave will not propagate successfully over anything other than short distances. To achieve this, the series resonant circuit 30 is placed at a position where the E field produced by the antenna (particularly the series resonant circuit 30) is 90 degrees out of phase with respect to the H field produced by the loop antenna 20. In fact, without the series resonant circuit 30, very little or no E field is produced by the antenna.

By arranging the circuit elements in this way, such that there is a 90 degree phase relationship between the E and H fields, the antenna can be made to function more effectively as both a receive and transmit antenna, since the H-field which would be produced alone (or essentially alone) by a loop antenna is supplemented by the E field from the series resonant circuit 30, which renders the transmitted energy from the antenna in a form suitable for transmission over far greater distances.

The series resonant circuit comprises an inductor L and a capacitor C and their values are chosen such that they resonate at the frequency of operation of the antenna. The resonance occurs when the reactance of the capacitor is equal to the reactance of the inductor i.e. when XL=Xc The values of L and C can thus be chosen to give the desired operating range. Other forms of series resonant circuit using e.g. crystal oscillators can be used to give other operating characteristics. If a crystal oscillator is used, the Q-value of such a circuit is far greater than that of the simple L-C circuit shown, which will consequently limit the bandwidth characteristics of the antenna.

The series resonant circuit is effectively operating as an E field radiator (which by virtue of the reciprocity inherent in antennas means it is an E field receiver too). The series resonant circuit operates as a quarter-wave ($\lambda/4$) antenna. It would be possible, in theory, but not generally so in practice, to simply have a rod antenna a quarter of a wavelength long in place of the series resonant circuit.

The positioning of the series resonant circuit is important: it must be positioned and coupled to the loop at a point where the phase difference between the E and H fields is 90 degrees. The amount of variation from precisely 90 degrees depends to some extent on the intended use of the antenna, but in general, the closer to 90 degrees exactly, the better is the performance of the antenna.

This is due to the fact that to ensure good propagation of the radio wave, the phase difference between the E and H fields must be as near to 90 degrees as possible. Also, the magnitude of the E and H fields should ideally be identical.

In practice, the point at which the series resonant element is coupled to the loop is found empirically through use of E and H field probes which are able to measure the phase difference between the E and H fields. The point of coupling is moved until the desired 90 degree difference is observed.

Thus, a degree of empirical measurement and trial and error is required to ensure optimum performance of the antenna, even though the principle underlying the arrangement of the elements is well understood. This is simply due to the nature of microstrip circuits, which often require a degree of 'tuning' before the desired performance is achieved.

Known simple loop antennas offer a very wide bandwidth typically one octave, whereas known antennas such as dipoles have a much narrower bandwidth—typically a much smaller fraction of the operating frequency (perhaps IMHz at the frequency of operation of a mobile telephone).

By combining a loop antenna with the series resonant circuit as shown in embodiments of the present invention, something of the best of both types of antennas can be achieved. In particular, since a loop antenna can generally only produce an H field and a voltage-fed fractional antenna can only operate at reduced efficiency, the combination of the two allows for greater efficiency than either could give alone from a given space.

Figure 2:
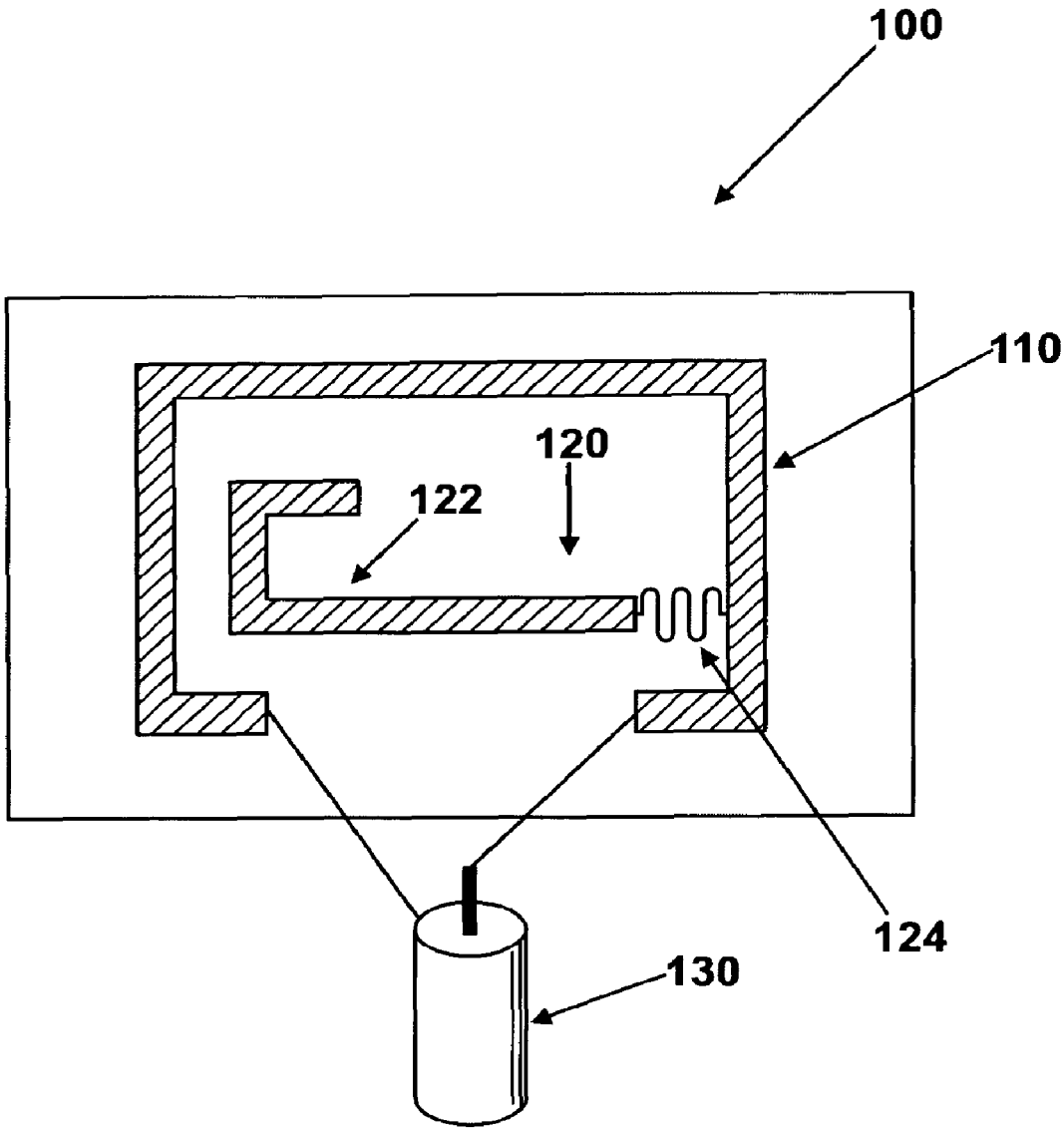
FIG. 2 shows a microstrip realisation of an embodiment of the invention.

FIG. 2 shows a practical realisation of the antenna, using microstrip construction techniques. Such printing techniques allow a compact and consistent antenna to be designed and built. An embodiment of the antenna built using this technique can easily be assembled into a mobile or handheld device e.g. telephone, PDA, laptop.

Microstrip techniques are well known and are not discussed in detail here. It is sufficient to say that copper traces are arranged (normally via etching or laser trimming) on a suitable substrate having a particular dielectric effect. By careful selection of materials and dimensions, particular values of capacitance and inductance can be achieved without the need for separate discrete components.

In fact, the basic layout of the antenna is arranged and manufactured using microstrip techniques. The final design is arrived at as a result of a certain amount of manual calibration whereby the physical traces on the substrate are adjusted. In practice, calibrated capacitance sticks are used which comprises a metallic element having a known capacitance element e.g. 2 picoFarads. The capacitance stick is placed in contact with various portions of the antenna trace and the performance of the antenna is measured.

In the hands of a skilled technician or designer, this technique reveals where the traces making up the antenna should be adjusted in size, equivalent to adjusting the capacitance and/or inductance. After a number of iterations, an antenna having the desired performance can be achieved.

The antenna shown in FIG. 2 is arranged on a section of printed circuit board 100, in a known way. The antenna comprises a loop 110 which, in this case is essentially rectangular, with a generally open base portion. The two ends of the generally open base portion are fed, as shown in FIG. 1 from a coaxial cable 130.

Located internally to the loop 110 is a series resonant circuit 120. The series resonant circuit takes the form of a J-shaped trace 122 on the circuit board which is coupled to the loop 100 by means of a meandering trace 124 (shown as an inductor, as that is the chief property of such a trace). The J-shaped trace 122 has essentially capacitive properties dictated by its dimension and the materials used for the antenna, and this trace functions with the meandering trace 124 as a series resonant circuit.

For use at a frequency of approximately 2.4 GHz, the value of C is in the range 0.5-2.0 pF and the value of L is approximately O.βnH. Microstrip design tables and/or programs can be used to design suitable traces having these values.

The point of connection between the series resonant element and the loop is again determined empirically using E and H field probes. Once the approximate position is determined, bearing in mind that at the frequency discussed here, the slightest interference from test equipment can have a large practical effect, fine adjustments can be made to the connection and/or the values of L and C by laser-trimming the traces in-situ. Once a final design is established, it can be reproduced with good repeatability again and again.

It is found empirically that an antenna built according to an embodiment of the present invention offers substantial efficiency gains over known antennas of a similar volume.

In a further embodiment of the present invention, a plurality of discrete antenna elements can be combined to offer a greater performance than can be achieved by use of a single element.

Figure 3:
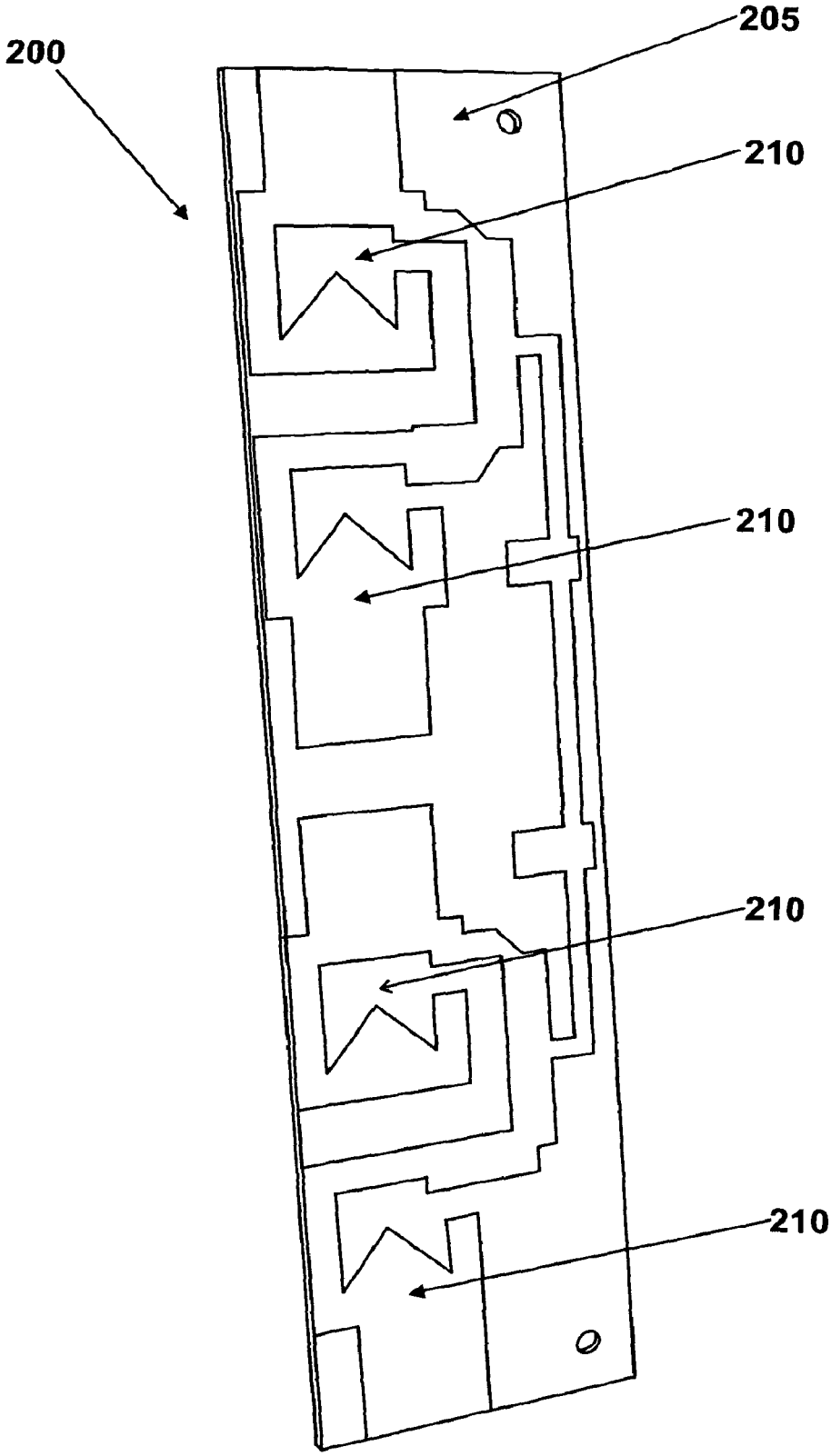
FIG. 3 shows a circuit layout of an embodiment of the present invention incorporating 4 discrete antenna elements.

FIG. 3 shows an antenna 200, arranged on a circuit board 205. The antenna 200 comprises four separate, functionally identical, antenna elements 210. They are arranged as two sets, each driven in parallel.

The effect of providing multiple instances of the basic antenna element 210 is to improve the overall performance of the antenna 200. In the absence of losses associated with the construction of the antenna, it would, in theory, be possible to construct an antenna comprising a great many individual instances of basic antenna elements, with each doubling of the number of elements adding 3 dB of gain to the antenna. In practice, however, losses—particularly dielectric heating effects—mean that it is not possible to add extra elements indefinitely. The example shown in FIG. 3 of a four-element antenna is well within the range of what is physically possible and adds 6 db (less any dielectric heating losses) of gain over an antenna consisting of a single element.

The antenna 200 of FIG. 3 is suitable for use in a microcellular base-station or other item of fixed wireless infrastructure, whereas a single element 210 is suitable for use in a mobile device, such as a cellular or mobile handset, pager, PDA or laptop computer. The only real determining issue is size.

Figure 4:
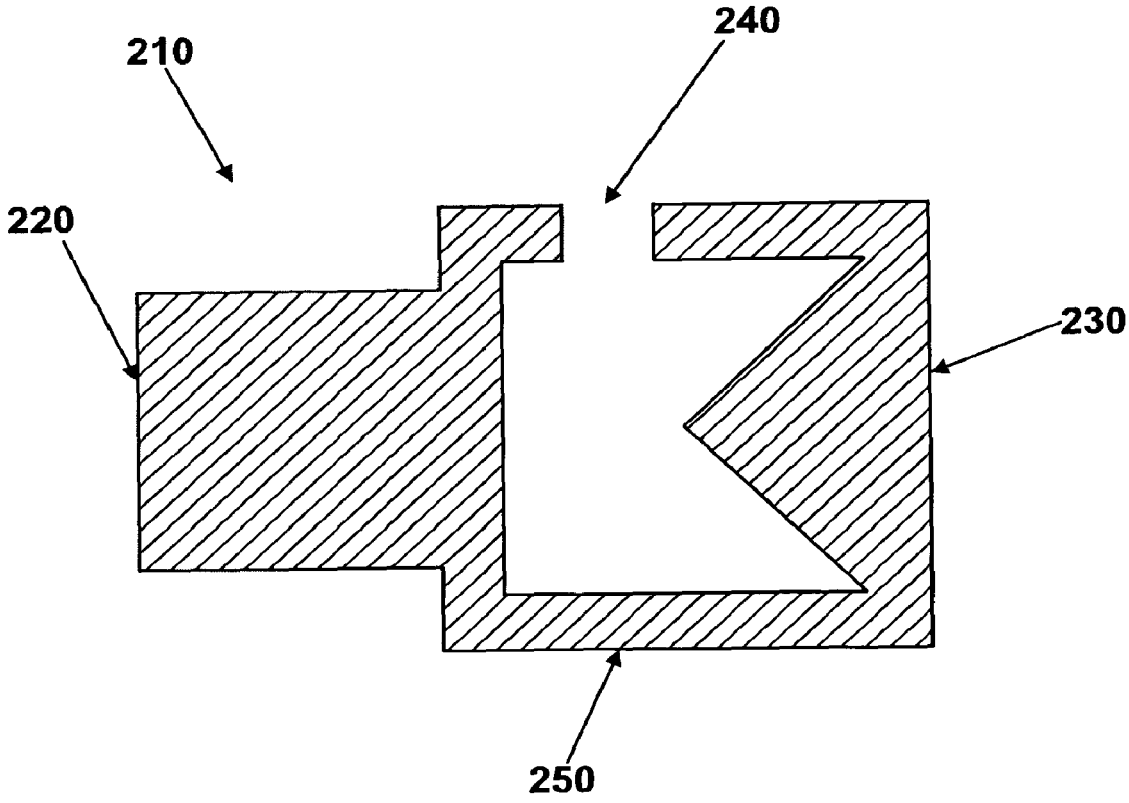
FIG. 4 shows a detailed view of one of the antenna elements of FIG. 3.

It can be seen that the antenna element 210 shown in FIG. 3 is different to that shown in FIG. 2. It is shown in greater detail in FIG. 4.

The antenna element 210 has been specifically adapted to provide a greater operational bandwidth. This is achieved, in particular by provision of a patch antenna 220 and a phase tracker 230, both of which are coupled to loop 250.

The patch antenna 220 replaces the tuned circuit 120 shown in FIG. 2, but also operates as an E-field radiator. However, the operating bandwidth of the patch antenna 220 is wider than that of the tuned circuit 120.

In the case of the tuned circuit 120, the connection point between the tuned circuit and the loop was important in determining the overall performance of the antenna. In the case of the patch antenna, since the connection point is effectively distributed along the length of one side of the patch antenna, the precise location is less important. The end points, where the edge of the patch meet the loop 250, together with the dimensions of the loop determine the operating frequency range of the antenna.

The loop dimensions are also important in determining the operating frequency of the antenna. In particular, the overall loop length is a key dimension, as mentioned previously. In order to allow for a wider operating frequency range, the triangular phase tracker element 230 is provided directly opposite the patch antenna (in one of two possible locations as shown in FIG. 3). The phase tracker 230 effectively acts as a variable length track, lengthening or shortening the loop, depending on the frequency of signal fed into it at feed point 240.

The phase tracker 230 is equivalent to a near-infinite series of L-C components, only some of which will resonate at a given frequency, thereby altering the effective length of the loop. In this way, a wider bandwidth of operation can be achieved than with a simple loop, having no such component.

The phase tracker 230 is shown in one of two different positions in FIG. 3. The reason for this is to do attempting to minimise mutual interference between adjacent antenna elements and both configurations are functionally identical.

In the antenna 200 of FIG. 3, the operational bandwidth is approximately 1.8-2.7 GHz, covering a great many frequency bands of interest, including those associated with WiFi, satellite and cellular communications. Further development of embodiments of the invention are likely to lead to even greater bandwidth.

It will be clear to the skilled person that any form of E-field radiator may be used in the multiple-element configuration shown in FIG. 3 and the patch antenna is merely an example. Likewise, a single-element embodiment may use a patch, a tuned circuit or any other suitable form of antenna.

The multiple element version shown in FIG. 3 uses four discrete elements, but this can be varied up or down depending on the exact system requirement and the space available.

Embodiments of the present invention allow for the use of either a single or multi-element antenna, operable over a much increased bandwidth and having superior performance characteristics, compared to similarly sized known antennas. Furthermore, no complex components are required, resulting in low-cost devices applicable to a wide range of RF devices.

Embodiments of the invention find particular use in mobile telecommunication devices, but can be used in any device where an efficient antenna is required in a small space.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment (s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A microstrip antenna, comprising;

a loop element;

a phase tracker including a triangular element conductively coupled to the loop element that alters an electric length of the loop element in response to an RS signal applied to the loop element; and an electric-field radiator electrically coupled to the circumference of the loop element at a position, at the frequency of operation, that creates a substantially 90 degree phase difference between an electric field and a magnetic field produced by the antenna.

2. The antenna of claim 1, wherein the electric-field radiator is a quarter-wavelength antenna.

3. The antenna of claim 1, wherein the electric-field radiator is a patch antenna.

4. The antenna of claim 1, wherein the phase tracker is positioned within the loop element and the position of the electric-field radiator is on an outside of the loop element and on a same side of the loop element as the phase tracker.

5. The antenna of claim 1, wherein the phase tracker is positioned within the loop element and the position of the electric-field radiator is on an outside of the loop element and on an opposite side of the loop element as the phase tracker.

6. The antenna of claim 1, wherein the phase tracker is electrically equivalent to a plurality of L-C components, only some of which resonate at any given frequency and alter the electrical length of the loop.

7. The antenna of claim 1, wherein the RF signal is between approximately 1.8GHz and approximately 2.7GHz.

8. A method of transmitting or receiving an RF signal using a microstrip antenna comprising the steps of:

generating a magnetic field with at least a loop element;

altering an electric length of the loop element in response to an RF signal applied to the loop element through use of a phase tracker including a triangular element conductively coupled to the loop element; and generating an electric field substantially 90 degrees out of phase from the magnetic field, at a frequency of operation, through use of at least an electric-field radiator electrically coupled to the circumference of the loop element.

9. The method of claim 8, wherein the electric-field radiator is a quarter-wavelength antenna.

10. The method of claim 8, wherein the electric-field radiator is a patch antenna.

11. The method of claim 8, wherein the phase tracker is positioned within the loop element and the position of the electric-field radiator is on the outside of the loop element and on a same side of the loop element as the phase tracker.

12. The method of claim 8, wherein the phase tracker is positioned within the loop element and the position of the electric-field radiator is on the outside of the loop element and on an opposite side of the loop element as the phase tracker.

13. The method of claim 8, wherein the phase tracker is electrically equivalent to a plurality of L-C components, only some of which resonate at any given frequency and alter the electrical length of the loop.

14. The method of claim 8, wherein the RF signal is between approximately 1.8GHz and approximately 2.7GHz.

* * * * *